United States Patent [19]

Barrow et al.

[11] Patent Number: 4,507,931

[45] Date of Patent: Apr. 2, 1985

[54] BOTTLING PLANT COOLING SYSTEMS

[75] Inventors: Billy E. Barrow, Sharpsburg; William E. Barrow, Newnan; Michael A. Barrow, Senoia, all of Ga.

[73] Assignee: Barrow Systems, Inc., Sharpsburg, Ga.

[21] Appl. No.: 625,993

[22] Filed: Jun. 29, 1984

[51] Int. Cl.[3] ..... B01F 3/04; F25B 41/04

[52] U.S. Cl. ..... 62/175; 62/217; 62/306

[58] Field of Search ..... 62/175, 217, 306, 524

[56] References Cited

U.S. PATENT DOCUMENTS

| | | | |
|---|---|---|---|
| 2,322,625 | 6/1943 | Geertz et al. | 62/306 |
| 2,375,319 | 5/1945 | Muffly | 62/217 X |
| 2,628,825 | 2/1953 | Kantor et al. | 62/306 X |
| 3,808,827 | 5/1974 | Avon et al. | 62/59 |
| 4,384,462 | 5/1983 | Overman et al. | 62/175 |

*Primary Examiner*—William E. Wayner

*Attorney, Agent, or Firm*—J. Rodgers Lunsford, III; Dale Lischer; William R. Cohrs

[57] ABSTRACT

There is disclosed a refrigeration system for a soft drink plant which refrigeration system provides cooling for cooler/carbonators used in the manufacturing of soft drink and which utilizes any access compressor capacity to precool water being used in the manufacture of soft drinks while assuring priority and adequate cooling capacity for the cooler/carbonators.

1 Claim, 2 Drawing Figures

BOTTLING PLANT COOLING SYSTEMS

BACKGROUND OF THE INVENTION

This invention relates generally to refrigeration systems and equipment, and more particularly concerns a refrigeration system for a soft drink bottling plant which is capable of producing significant electric power savings by fully utilizing all of the cooling capacity available in the system and under predetermined conditions removing cooling capacity which is not needed.

In a soft drink plant, the soft drink is constituted by mixing soft drink syrup with water and carbon dioxide ($CO_2$) gas at low temperatures in a beverage cooler/carbonator. The beverage cooler/carbonator is a pressure vessel that is charged with about two atmospheres of $CO_2$ gas. One type of cooler/carbonator has a baudelot corrugated cooling plate over which the mixture of water and syrup flows from top to bottom. As a film of the mixture of water and syrup descends over the cooling plate, the mixture is cooled to approximately 34° F. so that the mixture can absorb sufficient $CO_2$ gas to assure that the resulting soft drink beverage has the right volume of carbonation.

In order to assure quality in the production of soft drinks, the cooling plate in the cooler/carbonator must remain at a constant temperature (about 30° F.) during the carbonation of the syrup and water mixture. Any variations in temperature in the cooler/carbonator may result in inadequate carbonation of the beverage.

The cooling plates are evaporators having an inlet connected to a high pressure liquid refrigerant line and an outlet connected to a refrigeration suction line. The temperature of the cooling plate of the cooler/carbonator is directly related to the pressure at the suction line side of the cooling plate. The suction pressure is established by a constant pressure regulator valve, but the compressor unit connected to the suction line must be able to provide sufficiently low suction pressure to assure that there will be an adequate pressure drop across the regulator valve.

In a typical soft drink plant there may be several cooler/carbonators all connected to a single high pressure liquid refrigerant manifold and to a single refrigeration suction manifold and each having its own regulator valve. Also in a typical soft drink plant refrigeration capacity is provided by a bank of individually controllable compressor units connected to a single high pressure discharge manifold and the single suction manifold which compressor units can be turned on or shut off individually to increase or decrease refrigeration capacity as required.

During production, the cooler/carbonators cycle on and off due to interruptions or delays in the production line. If, for example, a cooler/carbonator is shut off because of an interruption in production, the compressor units continue to provide refrigeration capacity which is essentially wasted until the cooler/carbonator can be restarted. In prior art systems, false loading is often provided so that the refrigerant vapor is simply passed through a closed loop while the cooler/carbonator is shut off. Because on restart the cooler/carbonator requires full refrigeration capacity, compressor units cannot be shut off, or the refrigeration capacity will be insufficient when the cooler/carbonator restarts.

Moreover, to ensure a constant, ripple free temperature (suction pressure) in the cooler/carbonators even while normal uninterrupted production is proceeding, a certain percentage of overcapacity is required so that variations in incoming water temperature will not create a pressure ripple at the suction side of the cooling plates resulting in temperature ripple in the cooler/carbonators.

SUMMARY OF THE INVENTION

It is therefore a primary object of the present invention to provide a refrigeration system for a soft drink bottling plant which assures a constant ripple free temperature (suction pressure) in the cooler/carbonators while at the same time utilizes any excess compressor capacity to chill or precool the incoming water for use in the soft drink mixture.

It is a further object of the present invention to provide a control system for sequentially shutting down individual compressor units when the water at the inlet to the cooler/carbonators has been sufficiently cooled to allow for reduction in the amount of cooling capacity required to ensure a constant, ripple free temperature (suction pressure) at the cooler/carbonators.

In order to accomplish the above objectives, the refrigeration system includes a chiller for precooling the water held in a clear well or suitable reservoir, which water is ultimately mixed with the syrup and carbon dioxide in the cooler/carbonators. The chiller has its suction line connected to the suction manifold by means of a valving arrangement which ensures that the cooler/carbonators are maintained at a constant suction pressure (temperature) and that any extra cooling capacity, as determined by a lower suction pressure in the suction manifold, is diverted to the chiller in order to precool the water used in manufacturing the soft drink. By monitoring the suction pressure at the suction manifold, the control system can determine whether there is sufficient excess compressor capacity to allow for the shut down of individual compressor units thereby reducing the amount of electricity required by the compressors while at the same time ensuring sufficient cooling capacity to provide a constant ripple free temperature (suction pressure) at the cooler/carbonators.

Other objects and advantages of the invention will become apparent upon reading the following detailed description and upon reference to the drawings.

While the invention will be described in connection with an embodiment, it will be understood that we do not intend to limit the invention to that embodiment. On the contrary, we intend to cover all alternatives, modifications, and equivalents as may be included within the spirit and scope of the invention as defined by the appended claims.

Figure 1:
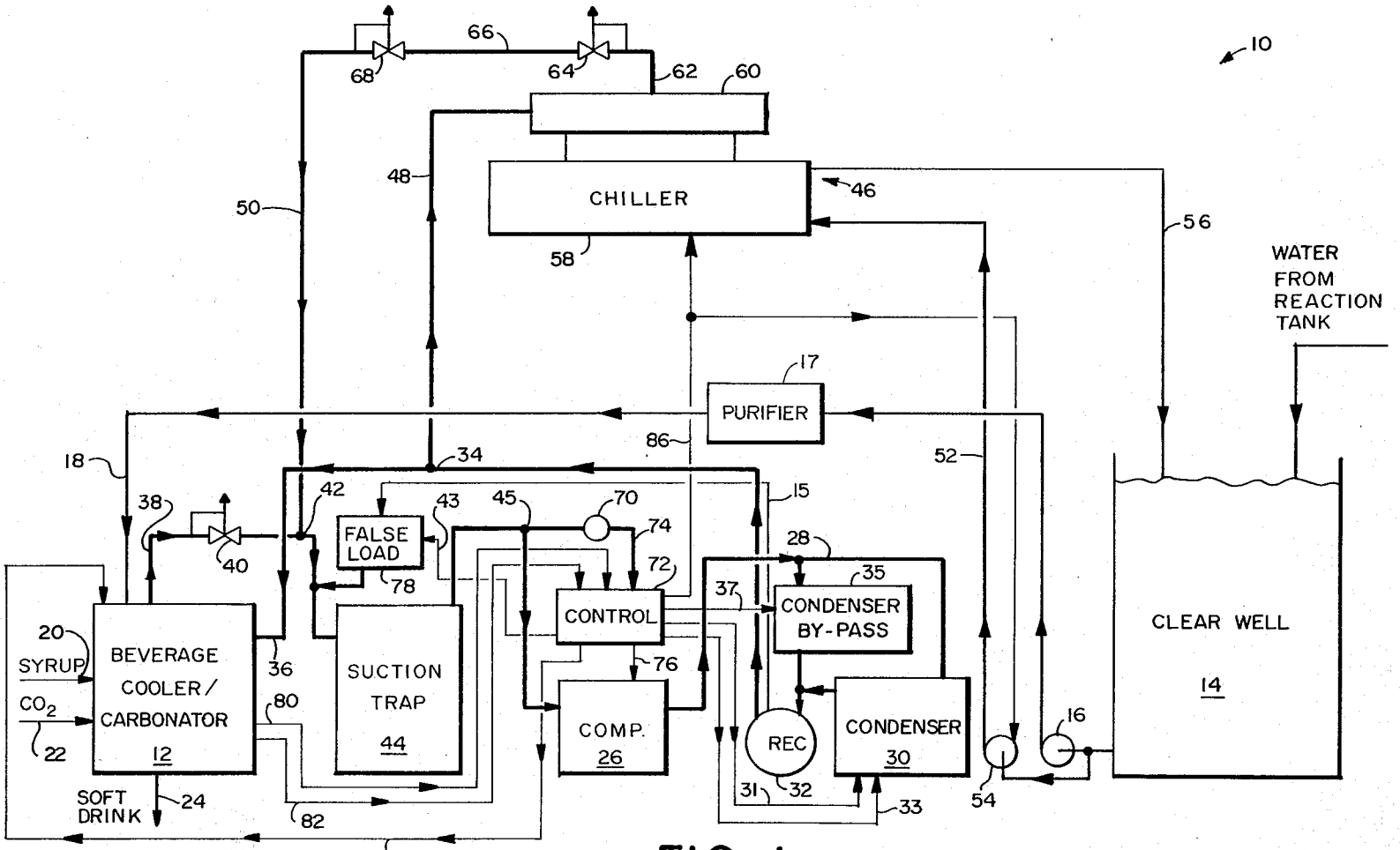
FIG. 1 is a schematic diagram of a refrigeration system which embodies the present invention.

Turning to FIG. 1, there is shown schematically a refrigeration system 10 for a soft drink bottling plant. The heart of a soft drink bottling plant is a beverage cooler/carbonator 12. The cooler/carbonator, which is well known in the art, is a pressure vessel charged with about two atmospheres of $CO_2$ gas. Water and soft drink syrup are mixed and pumped to the cooler/carbonator, and the mixture is then cooled in the presence of the $CO_2$ gas to produce the carbonated soft drink beverage which is then bottled or canned for sale.

Typically, a soft drink beverage is about 85% water. The soft drink bottling plant has facilities for treating water to assure that the water is pure and does not provide objectionable taste to the finished soft drink product. Once the water is treated in a reaction tank (not shown) it is stored in a reservoir or clear well 14. The clear well 14 may hold several thousand gallons and provides a large energy sink. From the clear well 14, a pump 16 pumps the water via a pipe 18, through an activated carbon filter 17, and to a blender (not shown) at the cooler/carbonator 12. A pipe 20 supplies soft drink syrup to the blender at the cooler/carbonator 12 where the water and the syrup are mixed in the proper proportions. $CO_2$ gas is provided via a pipe 22 to the cooler/carbonator to provide a carbon dioxide gas atmosphere (at about two atmospheres pressure) inside the cooler/carbonator. Cooling and carbonating of the mixture of syrup and water take place when a film of water and syrup falls over a baudelot corrugated type cooling plate (not shown) which is enclosed in the pressure vessel. As the mixture of water and syrup flow down over the corrugated cooling plates, the mixture is cooled and its ability to absorb $CO_2$ gas is increased so that a sufficient amount of $CO_2$ gas can be absorbed to provide the right carbonation for the finished beverage. At the bottom of the cooler/carbonator a drain pipe 24 provides an outlet for the carbonated soft drink beverage which is then connected to the soft drink plant's filler system (not shown).

In order to provide the right amount of carbonation, it is important that the cooling plate in the cooler/carbonator be maintained at a constant, ripple free temperature so that as the film of the water and syrup flows down the cooling plate, the beverage is instantaneously cooled to allow maximum absorption of $CO_2$ gas in the shortest time period, to thereby provide the right volume of $CO_2$ gas in the finished soft drink product, and to enhance the throughput of the cooler/carbonator. To ensure quality of the resulting soft drink beverage, it is important that the temperature of the plate not vary during production of the soft drink beverage.

In a typical soft drink plant, there may be a number of cooler/carbonators all being operated simultaneously and all being provided with refrigeration capacity by the same refrigeration system. With regard to the following description, it should be understood that the beverage cooler/carbonator 12 is merely illustrative of one of several beverage coolers which may be attached to the refrigeration system 10.

With continued reference to FIG. 1, the refrigeration system 10 includes individually controllable compressor units (shown collectively and identified by reference numeral 26). The compressor units 26 are conventional compressor units for compressing coolant vapor, such as ammonia, and are all parallel connected to high pressure discharge line 28. The compressed vapor in discharge line 28 is condensed to a liquid in condenser 30, and the liquid is collected in a receiving tank 32 which in turn is connected to high pressure liquid refrigerant manifold 34. The condenser 30 is of conventional design and has a fan and pump (not shown) which are controlled by start signals on lines 31 and 33 respectively. Also, a condenser bypass 35 is provided which allows additional pressurization in the receiving tank 32 during certain low ambient temperature conditions (winter). The bypass 35 is activated by a control signal on line 37.

A high pressure liquid refrigerant inlet pipe 36 connects the cooling plate of the cooler/carbonator 12 to the high pressure liquid refrigerant manifold 34 so that the coolant liquid can flow into the cooling plate. An outlet pipe 38 from the cooling plate connects the cooling plate to suction manifold 42 via a constant pressure cooler regulator 40. The suction manifold 42 is in turn connected to a conventional suction trap 44 and from there to the compressor units 26 by means of a suction line 45.

False load valves 78 are provided between high pressure receiver 32 and suction manifold 42. The false load valves are controlled by a control signal on line 43. The false load valves 78 are only active in the refrigeration system 10 when there is a catastrophic drop in pressure at the suction manifold 42, such as at the end of a shift or at a lunch break when all cooler/carbonators are shut down at once and before compressor units 26 can be shut down.

During normal uninterrupted operation of the cooler/carbonator 12, the compressor units 26 provide sufficient suction pressure in suction manifold 42 to assure that the constant pressure cooler regulator 40 can maintain a constant suction pressure at outlet 38 and therefore a constant temperature in the cooler/carbonator. As long as the suction pressure at outlet 38 remains constant, the temperature of the cooling plate remains constant. In a conventional refrigeration system, in order to ensure that the suction pressure at inlet 38 remains constant and ripple free, it is necessary to provide a lower suction pressure at manifold 42 when the cooler/carbonator is operating at its full, uninterrupted capacity. As a result of the lower suction pressure a considerable amount of excess cooling capacity is available but is wasted. Moreover, because compressor units are rated in discreet capacities (50, 75, 100 horsepower), it is unlikely that the individual compressor units when operating in parallel will provide the exact cooling capacity required and excess capacity will result even during uninterrupted cooler/carbonator operation.

Because the cooler/carbonators in a soft drink plant together produce soft drink beverage faster than the filler units can accommodate it, one or more of the cooler/carbonators during normal production will cycle off in order to allow the filler units to catch up. Moreover, if there are any problems in the filler units, one or more of the cooler/carbonators will also be forced to stop.

When the blender at the cooler/carbonator is shut off and water flow in pipe 18 and syrup flow in pipe 20 ceases, the cooler/carbonator no longer requires refrigeration capacity and excessive (low) suction pressure is created at manifold 42. In conventional systems, only false load valves 78 are provided between suction manifold 42 and high pressure receiver 32 in order to divert the extra cooling capacity which has become available because the cooler/carbonator no longer requires cooling capacity. Moreover, in a conventional refrigeration system the compressor units 26 cannot be shut down when the cooler/carbonator is shut down because, when the cooler/carbonator is restarted, it requires instantaneous and full cooling capacity which must be available in terms of suction pressure at the suction manifold when the cooler/carbonator restarts. If compressor units have been shut down and full cooling capacity is not available at the suction manifold, the suction pressure at outlet 38 will vary, the cooling plate temperature will vary, and defective soft drink beverage will be produced until sufficient compressor capacity can be brought on line.

In order to utilize any excess compressor capacity resulting from overcapacity during uninterrupted operation or resulting from interruption of production and in accordance with the present invention, a chiller 46 is provided to utilize the excess compressor capacity that is generally available even while full uninterrupted production is taking place and to utilize particularly the extra cooling capacity that is available when a cooler/-carbonator is turned off.

The chiller 46 is connected to the high pressure liquid refrigerant manifold 34 via line 48 and to the suction manifold 42 via line 50. Water from the clear well 14 is pumped to the chiller through pipe 52 by means of pump 54 and returned to the clear well via pipe 56. The chiller 46 includes an evaporator section 58 and a surge tank section 60. The chiller 46 has a suction outlet 62 which is connected through a constant pressure chiller regulator 64, via pipe 66, through constant pressure manifold regulator 68, pipe 50, and then to suction manifold 42.

The regulator 64 is a constant pressure regulator which assures that suction pressure in outlet 62 is kept at or below a predetermined set point which is directly related to a temperature in the evaporation section 58. Any time that the pressure in outlet 62 increases above the predetermined set point, the regulator 64 allows vapor to pass through the regulator into pipe 66.

Regulator 68, on the other hand, is a constant outlet pressure regulator which gradually opens when the suction pressure in the suction manifold 42 has decreased to a predetermined set point indicating that there is excess refrigeration capacity being provided by the compressor units 26. The set point for regulator 68 is such that the cooler/carbonators always have priority to the refrigeration capacity provided by the suction pressure in suction manifold 42.

Typically, and by way of illustration only, cooler regulator 40 is set for a constant suction pressure at outlet 38 of 45 psig (30° F. for ammonia refrigerant), chiller regulator 64 is set for a constant regulator pressure of 49 psig (33° F. for ammonia refrigerant) at outlet 62, and manifold regulator 68 is set for a constant pressure of 37 psig at the suction manifold 42.

With those illustrative set points, and assuming that the suction pressure in manifold 42 is initially 39 psig, regulator 40 will be modulated open to maintain the suction pressure in line 38 at 45 psig. Six pounds of suction pressure are inherently lost in the lines and valving between outlet 38 and the suction manifold 42. The manifold regulator 68, however, will not be opened because it does not open until the suction pressure in suction manifold 42 reaches 37 psig or less. Therefore, no vapor will pass through regulator 68 and as a result no cooling will take place in the chiller 46. Becasuse there will always be excess compressor capacity available at compressor units 26, the suction pressure at suction manifold 42 will gradually decrease until it reaches 37 psig. At that point, regulator 68 will begin allowing vapor to pass in order to try to maintain the suction pressure at 37 psig in suction manifold 42. Because the water in the chiller will be above 33° F. and the ammonia pressure will therefore be above 49 psig the regulator 64 will be open in an attempt to bring the pressure in outlet 62 down to 49 psig and thereby reduce the temperature in the chiller toward 33° F.

Assuming that compressor capacity on line remains unchanged, the pressure in the suction manifold will continue to decrease below 35 psig as the water in the chiller is cooled and the cooler water is supplied to the cooler/carbonator. By supplying cooler water to the cooler/carbonator, the cooler/carbonator requires less cooling capacity and the resulting excess capacity is used in the chiller to further cool the water in the clear-well or energy sink.

At some point, the pressure in the suction manifold will be decreased to such a point that it will be possible to unload and take off line one of the controllable compressor units. Illustrative at 35 psig, 33 psig, 31 psig, and 29 psig each of four banks of a four bank compressor are unloaded. If the 29 psig pressure (or lower pressure) lasts for two minutes the first compressor (with its four banks previously unloaded) is shut off altogether.

When enough of the compressor units are taken off line, the suction pressure in the suction manifold will increase to a point where less and less cooling capacity will be available to the chiller. Gradually, over time, the water in the clear well will begin to warm up, and the warmer water in pipe 18 supplied to the cooler/carbonator will increase the load of the cooler/carbonator thereby increasing the demand for cooling capacity in the cooler/carbonator and allowing less cooling capacity to the chiller. As the water warms up and the cooler/carbonator requires more and more cooling capacity, the suction pressure in suction manifold 42 will gradually rise until it exceeds 37 psig, the set point of regulator 68, and all cooling capacity to the chiller will be shut off. With the chiller no longer operating, the water in the clear well will continue to increase in temperature and the cooler/carbonator will continue to require more cooling capacity thereby raising the pressure in the suction manifold even higher. As the suction manifold pressure approaches 39 psig, the maximum pressure allowed to assure that the regulator 40 can maintain 45 psig for the cooler/carbonator, a compressor unit will have to be restarted to provide the necessary cooling capacity. With the addition of compressor capacity, the suction pressure in the suction manifold will begin decreasing until the chiller is again brought on line by the action of manifold regulator 68, and the cycle continues.

In order to control the adding and subtracting of compressor units from the system, a sensing circuit 70 is attached to the suction line 45. The sensing circuit senses the pressure in suction line 45 which is essentially the same as the pressure in suction manifold 42 and communicates that information by means of an electrical analog signal to a controller 72. The controller 72 in response to the changes in pressure in the suction manifold (and other control signals) calls for additional compressor units to satisfy the need of the system or orders individual compressor units to drop out and in turn save electric power when the water in the clear well has been sufficiently cooled to allow greater efficiency in the cooler/carbonator.

Other control signals which are provided to the controller 72 include a control signal on line 80 which indicates that the beverage cooler/carbonator is on or off (i.e. refrigerant is available at inlet 36) and a control signal on line 82 which indicates that water and syrup are being blended and are flowing into the cooler/carbonator. The other control and sensing signals include various system safety sensors which will be described in greater detail with reference to FIG. 2 and which are not shown in FIG. 1.

The controller 72, by processing the inputs on lines 80 and 82 which indicate that the beverage cooler is on or off and that the blender at the beverage cooler is on or off and by monitoring the suction pressure at input 74, produces a series of control signals on lines 43, 84, 76, 31, 33, 37, and 86. Generally the control signals control the system as follows.

The control signal on line 43 activates the false load valves 78 when there is a catastrophic shutdown. With the present invention, the chiller will provide vapor to the suction manifold thereby virtually eliminating the chance of a catastrophic shutdown. In the event the chiller is not in operation the false load valves allow the controller 72 time in which to shut down the compressor capacity that was being used at the time the complete shutdown of the cooler/carbonators takes place.

The control signal on line 84 will sound an alarm and light a flashing light when a system safety sensor indicates a failure somewhere in the system. When further refrigeration capacity is required and there is none available, there is a chance of warm beverage being produced. The signal on line 84 will shut the blenders off to prevent an undesirable beverage from being produced at the output of the cooler/carbonator.

The control signals on lines 31 and 33 activate the fan and pump of the condenser 30, and the signal on line 37 activates the condenser bypass 35 under certain low ambient temperature conditions (winter).

The control signal on line 86 controls the chiller by making refrigerant available to the chiller at inlet 48 and also starts the water pump 54 to provide water to the chiller.

Finally, control signal 76, which is the main control signal used in connection with the inventive concept of the present invention, either calls for additional compressor capacity needed or removes excessive compressor capacity from the system.

Figure 2:
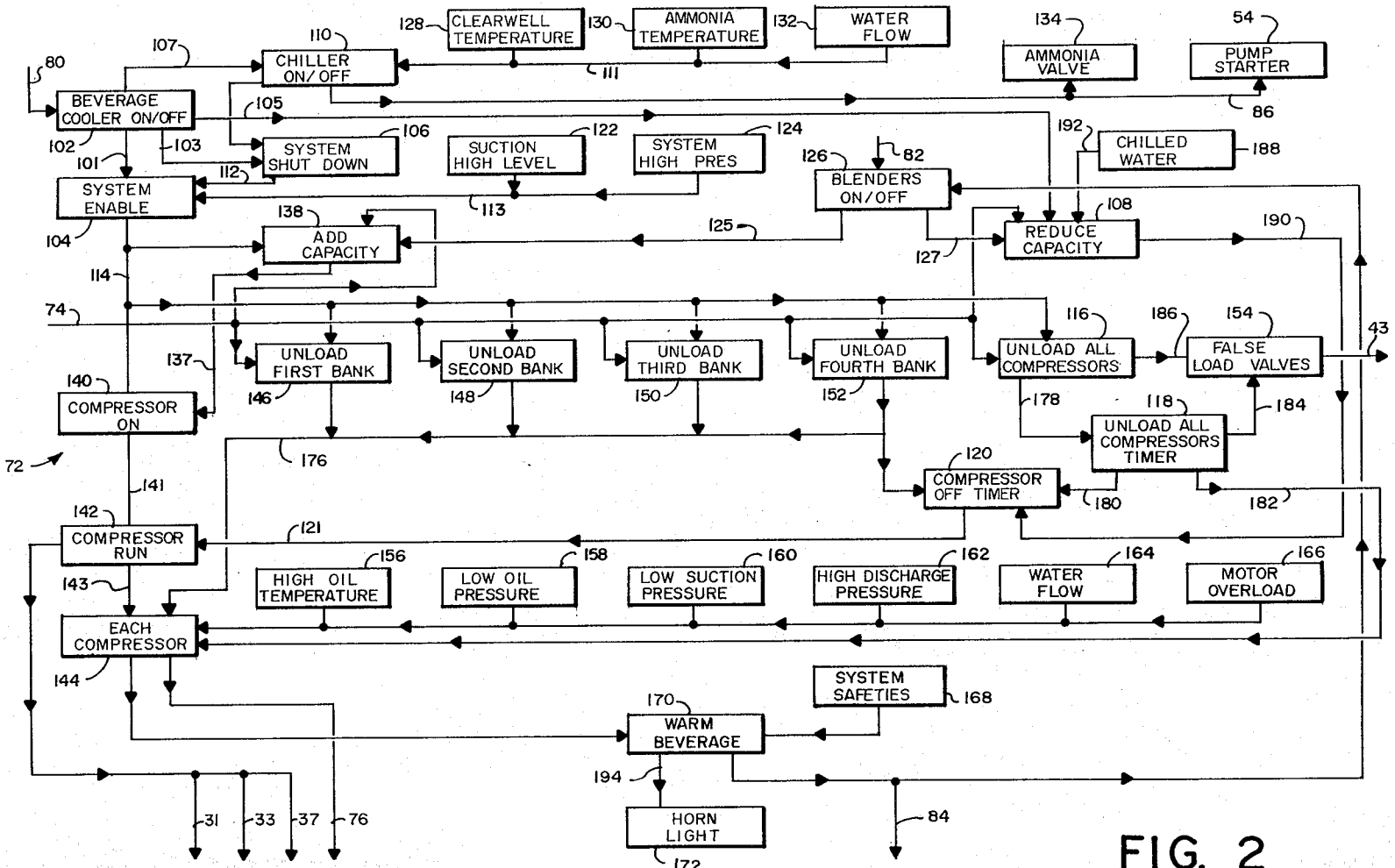
FIG. 2 is a block diagram illustrating a control system for use with the refrigeration system shown in FIG. 1.

Turning then to FIG. 2 there is shown a controller 72 in block diagram form which controller will assure that the refrigeration system shown in FIG. 1 operates in accordance with the inventive concept of the present invention. While the controller shown in FIG. 2 is a preferred embodiment of the controller, it is contemplated that a person of ordinary skill in the art, who has been given the protocol for monitoring the suction manifold pressure and has been given the disclosure concerning the construction and operation of the chiller in connection with the refrigeration system 10 of the present invention, would be able to construct other control systems which allow control of the refrigeration system 10 without departing from the spirit and scope of the present invention.

The sequence of events is illustrated in Table 1 below which shows the basic control sequence as the suction pressure varies within the range provided.

TABLE 1

| Suction Pressure | Event |
|---|---|
| 39 psig | all cooler/carbonators running; chiller not operating; some excess compressor capacity |
| 37 psig | regulator 68 begins to open and chiller begins precooling (assuming water above 33° F.). |
| 35 psig | unload first (of four) bank of last compressor in sequence |
| 33 psig | unload second bank |
| 31 psig | unload third bank |
| 29 psig | unload fourth bank |
| 29 psig + 2 min. | shut off first compressor |
| 29 psig + 4 min. | shut off second compressor |
| 29 psig + 6 min. | shut off third compressor |

TABLE 1-continued

| Suction Pressure | Event |
|---|---|
| 27 psig | activate false load valves |
| 30 psig | deactivate false load valves and load fourth bank (if compressor is running) |
| 32 psig | reload third bank |
| 34 psig | reload second bank |
| 36 psig | reload first bank |
| 37 psig | regulator 68 closes deactivating chiller |
| 39 psig | compressors restart sequentially in 10 second intervals |
| 38 psig | compressor restarting sequence ends. |

In order to carry out the control sequence set forth in Table 1 above, and to provide other system functions, the controller 72 has inputs 74, 82, and 80. As previously stated, input 74 is the analog electrical signal which is proportional to the suction pressure set forth in Table 1 above. The signal on control line 80 is a derived signal which indicates that at least one of the cooler/carbonators is on. Likewise, the control signal on line 82 indicates that at least one of the blenders at the cooler/carbonators is on.

The control signal 80 indicating that at least one of the beverage coolers is on is connected to beverage cooler circuit 102. Beverage cooler circuit 102 has outputs 101, 103, 105, and 107 which are respectively connected to system enable circuit 104, shut down circuit 106, reduce capacity circuit 108, and chiller on/off circuit 110. The outputs 101, 103, 105, and 107 indicate to those respective circuits that at least one of the beverage coolers is on and operating.

The system enable circuit 104 has an output 114 indicating that the refrigeration system 10 (FIG. 1) is enabled for operation when at least one beverage cooler is on (signal on line 101 is present), when the shut down output signal on line 112 from shut down circuit 106 is not present, and when certain safety conditions are met as indicated by a signal on line 113 from suction high level circuit 122 and system high pressure circuit 124. Suction high level circuit 122 simply senses when the level of the liquid refrigerant in the suction trap 44 (FIG. 1) has accumulated to such a high level that it might be sucked into the compressors thereby damaging the compressors. System high pressure circuit 124 simply senses when the refrigerant pressure at the high pressure discharge manifold 28 (FIG. 1) has exceeded a safe operating pressure. Once the conditions for system operation have been satisfied, system enable circuit 104 produces a system enable signal at its output on line 114.

The system enable signal on line 114 is connected to the add capacity circuit 138, if the pressure in the suction manifold is above the add capacity set point, one compressor will start thereby reducing the pressure in the suction manifold so that when the blender starts refrigeration capacity will be ready instantly thereby eliminating the chance of warm product. Also the system enable signal on line 114 is connected to the compressor on circuit 140, the unload all compressors circuit 116, unload first bank circuit 146, unload second bank circuit 148, unload third bank circuit 150, and unload fourth bank circuit 152.

Once the system has been enabled as previously described, the blenders at the beverage cooler/carbonators are turned on, and a signal appears at input line 82 indicating that at least one of the blenders is on. With at least one of the blenders on, blender on/off circuit 126 produces an output signal on lines 125 and 127 indicating that soft drink mixture is being processed and that the system ought to be ready either to add capacity (add capacity circuit 138) or to reduce the capacity (reduce capacity circuit 108) as indicated by the suction manifold pressure on input line 74.

Assuming that the suction pressure on input line 74 is 39 psig with all cooler/carbonators running and only minimum compressor capacity has been started, the add capacity circuit 138 in response to the high suction pressure on input line 74, to the system enable signal on its input line 114, and to the blender on signal on its input line 125 produces an output signal on line 137 which is summed with the system enable signal 114 at compressor on circuit 140 to produce a compressor on signal on line 141. The compressor on signal on line 141 is a timed signal which sequentially (about every 8 to 10 seconds) produces a compressor on signal on line 141 which is connected to compressor run circuit 142.

Compressor run circuit 142 produces a compressor run signal on multiple lines 143 which are connected to each of a number of compressor circuits 144. In a typical operation, compressor circuit 144 is duplicated a number of times for each of the compressors in the system. For the sake of simplicity, only one of the compressor circuits 144 is shown. Compressor circuit 144 having received a compressor run signal on line 143 checks with system safety sensors such as high oil temperature 156, low oil pressure 158, low suction pressure 160, high discharge pressure 162, water flow 164, and motor overload 166 before it produces a run signal on line 76 which is connected to the particular compressor associated with compressor circuit 144.

The compressor run circuit 142 in response to the timed sequential compressor on signal on line 141 starts each of the available compressors until the start sequence is terminated by a disable signal on line 121 indicating that no further compressor capacity is required. Moreover, compressor run circuit 142 produces condenser control signals on lines 31, 33, and 37 which respectively start the condenser fan, the condenser pump if needed, and under certain conditions of ambient temperature operate the condenser bypass 35.

As the compressors begin restarting in response to commands from the compressor run circuit 142, the suction pressure at line 74 (suction manifold pressure) will begin decreasing below 39 psig, the assumed starting point. Once the pressure drops below 39 psig, such as 38 psig, the add capacity circuit 138 will be disabled, which in turn will disable the timing sequence of the compressor on circuit 140, and the sequencing of compressor run circuit 142 will halt. At that point, sufficient compressor capacity will have been added to the system to exceed the full load requirements of the cooler/carbonators that are on line and operating in an uninterrupted fashion.

During the startup sequence of the compressors, the beverage cooler on/off circuit 102 also produces an output signal on line 107 to turn on the chiller 46 by means of chiller on/off circuit 110. The chiller on/off circuit 110 is activated in response to the beverage cooler on signal on line 107 if certain operating conditions are also satisfied as indicated on input line 111. Those operating conditions include the clear well temperature 128 being above a certain point, the refrigerant temperature 130 being within specified ranges, and the water flow 132 being present. With those conditions satisfied and the beverage cooler on signal on line 107 present, chiller on/off circuit 110 produces an output on line 86 (FIG. 1) which opens the inlet refrigerant valve 134 and starts the pump 54 to circulate water from clear well 14 through the chiller.

Returning to the continuing operation of the system and assuming that all cooler/carbonators are running in an uninterrupted fashion with excess compressor capacity available, the suction pressure at line 74 will continue to drop below 38 psig, a point at which compressor restarting sequence ends, until it reaches 37 psig, for example. At 37 psig, regulator valve 68 (FIG. 1) beings to open and allows refrigerant to circulate through the chiller 46 to begin cooling the water, assuming that the water temperature is initially above 33° F. (sensor 188).

Assuming that there is still sufficient excess compressor capacity on line, even with the chiller operating, the suction manifold pressure on line 74 will continue to drop until it reaches 35 psig for example. At that point, the reduce capacity circuit 108 will be enabled, i.e., the beverage cooler/carbonators are on (line 105), the blenders are on (line 127), and the chiller water is above 33° F. (temperature sensor 188 and line 192). Also at that point, unload first bank circuit 146 will be activated in response to that pressure and will produce an unload signal on line 176 which signal will be connected to the last compressor brought on line which is controlled by compressor circuit 144. The unload first bank signal on line 176 will unload the first bank of the last compressor controlled by circuit 144.

If unloading one of four banks of the last compressor brought on line is sufficient to keep the manifold pressure on line 74 from dropping further, the system will continue to run with the last compressor brought on line driving only three of its four banks of cylinders. If, however, unloading one bank of the four bank compressor that was brought on line still allows excess cooling capacity on line, the pressure in the suction manifold will continue to drop until unload second bank circuit 148 is activated producing unload second bank signal on line 176 which will unload the second bank of the last compressor brought on line. With reference to Table 1, the unload third bank circuit 150 will be activated at 33 psig, for example, and the unload fourth bank circuit 152 will be activated at 29 psig.

Once all four banks have been unloaded, the signal on line 176 indicating that all four banks are unloaded activates compressor off timing circuit 120 assuming that the reduce capacity signal on line 190 is still present. After two minutes, compressor off timing circuit 120 produces a compressor off signal on line 121 which conditions compressor run circuit 142 and causes compressor circuit 142 to shut off the last compressor brought on line by means of an output signal on line 143 connected to compressor circuit 144 which is associated with the last compressor brought on line. At that point, an entire compressor has been taken off line.

If the pressure continues to drop to between 27 psig and 25 psig, the pressure signal on line 74 will activate an unload all compressor circuit 116 which will send a signal to the unload all compressor timing circuit 118. The timing circuit 118 will, when timed out, send a signal to the compressor off timer 120. The compressor off timer 120, after a preset time and assuming the reduce capacity signal on line 190 is still present, will send a signal on line 121 which conditions compressor run circuit 142 and causes compressor run circuit 142 to shut off the last compressor brought on line by means of an output signal on line 143 connected to compressor circuit 144 which is associated with the last compressor brought on line. Again assuming the reduce capacity signal on line 190 is still present, a compressor will be timed off every time the compressor off timer 120 times out and resets until all compressors are shut off. An exception occurs when the beverage cooler on/off circuit 80 is selected in its off position. In that circumstance a signal will be sent on line 103 to the system shutdown circuit 106. After a preset time, the entire refrigeration system 10 would shut down.

What is claimed is:

1. A refrigeration system comprising:

(a) compressor units individually controllable and each connected to a high pressure manifold and a suction manifold;

(b) cooler means connected to the high pressure manifold and connected via a constant pressure cooler regulator to the suction manifold;

(c) chiller means connected to the high pressure manifold and connected via a constant pressure chiller regulator and a constant pressure manifold regulator to the suction manifold;

(d) means for supplying water from a common reservoir to the cooler means and the chiller means and for returning water from the chiller means to the common reservoir;

(e) control means for monitoring suction pressure in the suction manifold and turning on or turning off individual compressor units in response thereto.

* * * * *